US011306540B2

(12) United States Patent
Liu et al.

(10) Patent No.: US 11,306,540 B2
(45) Date of Patent: Apr. 19, 2022

(54) PUSH TYPE ROTARY GUIDE DRILLING SYSTEM

(71) Applicant: INSTITUTE OF GEOLOGY AND GEOPHYSICS, CHINESE ACADEMY OF SCIENCES, Beijing (CN)

(72) Inventors: Qingbo Liu, Beijing (CN); Qingyun Di, Beijing (CN); Xiangyang Wang, Beijing (CN); Yongyou Yang, Beijing (CN); Qijun Xie, Beijing (CN); Xinzhen He, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/263,804

(22) PCT Filed: Jul. 1, 2020

(86) PCT No.: PCT/CN2020/099627
§ 371 (c)(1),
(2) Date: Jan. 27, 2021

(87) PCT Pub. No.: WO2021/253503
PCT Pub. Date: Dec. 23, 2021

(65) Prior Publication Data

US 2021/0396078 A1 Dec. 23, 2021

(30) Foreign Application Priority Data

Jun. 17, 2020 (CN) ..... 202010553921.6

(51) Int. Cl.
*E21B 7/06* (2006.01)

(52) U.S. Cl.
CPC ..... *E21B 7/062* (2013.01); *E21B 7/064* (2013.01)

(58) Field of Classification Search
CPC . E21B 7/06; E21B 7/061; E21B 7/062; E21B 7/064; E21B 34/066
See application file for complete search history.

(56) References Cited

U.S. PATENT DOCUMENTS 4,776,397 A * 10/1988 Akkerman ..... E21B 17/1021 166/241.5
5,655,609 A * 8/1997 Brown ..... E21B 17/1014 175/325.1

(Continued)

FOREIGN PATENT DOCUMENTS

CN 101696628 B 10/2013
CN 105134075 A 12/2015

(Continued)

OTHER PUBLICATIONS

Written Opinion of the International Searching Authority (Form PCT/ISA/237); dated Mar. 17, 2021 in corresponding PCT Application No. PCT/CN2020/099627 (4 pages) (4 pages English Translation).

(Continued)

*Primary Examiner* — Taras P Bemko

(57) ABSTRACT

A push type rotary guide drilling system includes a drill bit and a rotating shaft, the rotating shaft including an upper rotating shaft and a lower rotating shaft; a steering portion, sleeving an outer side of the rotating shaft; a push assembly, including a plurality of push pieces spaced along a circumferential direction of the steering portion; a transmission device, including a transmission mechanism for driving the push pieces to extend out of the steering portion, the transmission mechanism including a driving electromagnetic gear arranged on the upper rotating shaft and a driven (Continued)

electromagnetic gear arranged on the steering portion and further including a motion conversion unit converting rotary motion of the driven electromagnetic gear into linear motion of the push pieces; and a control unit. The control unit is configured to modulate a magnetic field to make the driving electromagnetic gear and the driven electromagnetic gear realize linkage through magnetic coupling.

20 Claims, 1 Drawing Sheet

(56) References Cited

U.S. PATENT DOCUMENTS

| | | | | |
|---|---|---|---|---|
| 8,256,538 | B1 | 9/2012 | Deslierres et al. | |
| 10,683,702 | B2 * | 6/2020 | Conger | E21B 34/06 |
| 10,837,235 | B2 * | 11/2020 | Liu | E21B 17/1014 |
| 2003/0221867 | A1 | 12/2003 | Westmeyer et al. | |
| 2012/0118646 | A1 | 5/2012 | Russell et al. | |
| 2012/0273238 | A1 * | 11/2012 | Boekholtz | E21B 23/01 166/383 |
| 2016/0326805 | A1 * | 11/2016 | Gao | E21B 7/067 |
| 2020/0190909 | A1 * | 6/2020 | Liu | E21B 7/068 |

FOREIGN PATENT DOCUMENTS

| | | | |
|---|---|---|---|
| CN | 109025820 | A | 8/2019 |
| CN | 111287655 | A | 6/2020 |

OTHER PUBLICATIONS

First Office Action dated Nov. 13, 2020 in corresponding Chinese Patent Application No. 202010553921.6 (3 pages) (5 pages English Translation).

Search Report dated Nov. 13, 2020 in corresponding Chinese Patent Application No. 202010553921.6 (3 pages) (2 pages English Translation).

* cited by examiner

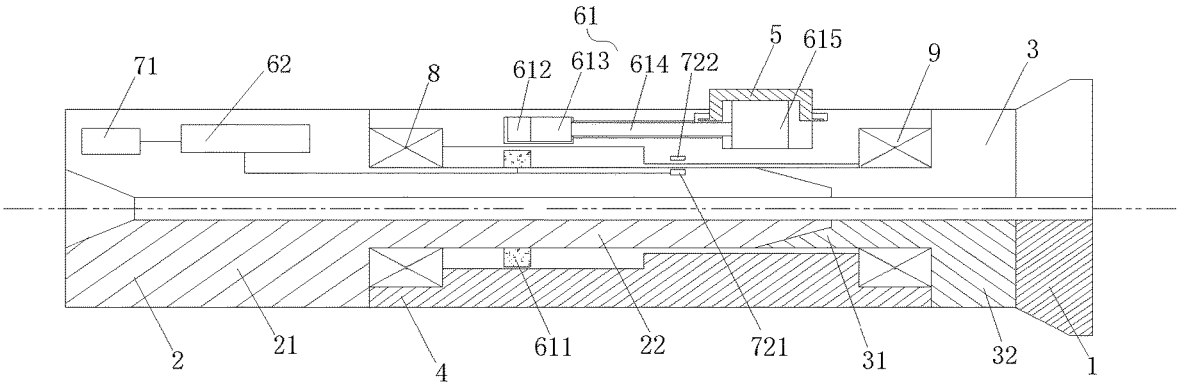
61
71
62
8
612
613
614
722
5
615
9
3
2
21
4
611
22
721
31
32
1

PUSH TYPE ROTARY GUIDE DRILLING SYSTEM

CROSS REFERENCE TO RELATED APPLICATIONS

This application is a U.S. National Stage Application under 35 U.S.C. § 371 of PCT International Patent Application No. PCT/CN2020/099627, filed on Jul. 1, 2020, which claims the foreign priority benefit under 35 U.S.C. § 119 of Chinese Patent Application No. 202010553921.6, filed on Jun. 17, 2020, in the China National Intellectual Property Administration, the contents of both of which International Patent Application and the Chinese Application are incorporated by reference herein in their entirety.

TECHNICAL FIELD

The present application relates to the field of drilling, and in particular, to a push type rotary guide drilling system.

BACKGROUND

It is necessary to perform well drilling and exploration in order to obtain natural resources stored underground. In many cases, the wellhole and the derrick are not aligned with each other, but need to form a certain offset or bend. This process of forming horizontal or vertical offset or other types of complex well holes is called directional drilling. The process of controlling the direction of the drill bit in the directional drilling process is called guide. There are two types of modern guide drilling: sliding guide and rotary guide. There are two commonly used rotary guide technologies, one is pointing type guide and the other one is push type guide.

The existing push type rotary guide drilling system consists of a ground monitoring system and an underground tool. The underground tool is divided three modules: a guide short joint, a measurement while drilling system and a bidirectional communication and power module, which are connected through standardized joints. The standardized joint includes a drill rod and a conductive device, which may complete connection among the modules, sealing and electronic connection.

The measurement while drilling system consists of a non-magnetic drill collar and a measurement while drilling exploring pipe and is configured to measure well deviation and azimuth and transmit the measured data to a pulse generator and a guide control system. The bidirectional communication and power module mainly includes a non-magnetic drill collar, a slurry generator, a pulse generator, an electronic cabin and the like, and is configured to provide electric energy for the underground tool and complete most of work of ground-underground bidirectional communication (that is, acquire an instruction signal downloaded by the ground monitoring system and transmitting a drilling fluid positive pulse signal to the ground). The guide short joint is an underground decision-making and executing mechanism when the rotary guide system and is configured to transmit a turntable torque to the drill bit and control a size and a direction of a lateral force of the drill bit laterally cutting the stratum. The guide short joint is complicated in structure and working condition, bears complicated load, and the performance and life of the guide short joint directly determine the advantage and the disadvantage of the rotary guide system, so the guide short joint is the core part of the rotary guide drilling system.

The existing guide short joint is a set of mechanical-electrical-hydraulic highly integrated underground tool and includes a guide executing mechanism, a guide control system, a transmission device, a rotating mandrel, a non-rotating outer cylinder, a lower joint and other mechanical structures. The guide executing mechanism includes a wing sheet, and the wing sheet may stretch out and draw back to push the well wall to change the posture of the guide short joint so as to adjust the posture of the drill bit. The guide control system is a relatively independent underground analysis and decision-making mechanism of the rotary guide drilling system and is configured to analyze and calculate the deviation of the well trajectory and the posture of the guide short joint and control the guide executing mechanism to work according to the deviation of the well trajectory and the posture of the guide short joint or the construction transmitted by the ground. The existing guide control system consists of a substrate and a control circuit, is mounted at the upper middle position in an annular space between the non-rotating outer cylinder and the rotating mandrel, has a certain gap with the rotating mandrel, and clings to an outer wall of the non-rotating outer cylinder through a sealing system and a limiting device. When the rotating mandrel rotates, the guide control system and the non-rotating outer cylinder are static relative to the rotating mandrel. Three conductive slots and threaded holes distributed circumferentially uniformly are formed in an lower part of the guide control system, the threaded holes are configured to connect an upper part of the hydraulic module to the guide control system, and the conductive slots are configured to communicating a power supply and communication line of the hydraulic module and the guide control system. The task of the transmission device is to transmit a signal and electric energy between the rotating mandrel and the non-rotating outer cylinder which rotate relatively. The rotating mandrel, the non-rotating outer cylinder, the lower joint and other mechanical structures are bearing structures of the guide short joint, are carriers of three subsystems of the guide short joint and transmit drilling pressure and torque.

A complex mechanical-electrical-hydraulic driving device is integrated in the existing non-rotating outer cylinder to drive deflection of the drill bit posture, for example, the prior art discloses a rotary guide device based on a radial driving force. At least three hydraulic driving mechanisms are arranged in the non-rotating outer cylinder of the guide device. Each of the hydraulic driving mechanisms is configured to drive the lower joint to deflect to make a lower centering device arranged on the lower joint to deflect, thereby changing the posture of the drill bit. For another example, there is a rotary guide device in the prior art, it is necessary to arrange a corresponding circuit component in the non-rotating outer cylinder to realize normal operation of the hydraulic driving mechanism. The corresponding circuit component is arranged in the non-rotating outer cylinder. On one hand, it is necessary to form an electric interface such as a conductive socket and the like or an opening for leading an electric wire at the non-rotating outer cylinder, and on the other hand, it is necessary to set a corresponding mounting structure for mounting the circuit component and other structure parts; moreover, it is necessary to reserve a mounting space for the circuit component to cause complex structure and increased size of the non-rotating outer cylinder, thereby increasing the size of the whole guide drilling system. The increase of the whole machine size not only increases the cost, but also affects the flexibility of the underground feeding motion of the guide drilling system.

In addition, the underground environment is complex and harsh. In the drilling process, to prevent the underground impurities from entering the non-rotating outer cylinder through joint gaps between the rotating mandrel and the non-rotating outer cylinder and between the non-rotating outer cylinder and the lower joint to avoid the influence on the normal operation of the electronic components in the non-rotating outer cylinder, it is necessary to design corresponding sealing structure and the like, which greatly increases the sealing cost.

Furthermore, for the technology that the hydraulic mechanism arranged on the non-rotating outer cylinder drives the lower joint to deflect, generally, the piston is driven by the hydraulic cylinder, the corresponding push part is driven by the piston to stretch out and draw back to drive the lower joint to deflect, and the extension and retraction of the push part is in a normal state underground. To prevent the underground impurities from entering the non-rotating outer cylinder through the joint position of the push part and the non-rotating outer cylinder, it is necessary to set corresponding dynamic sealing structures, with high cost and low reliability.

SUMMARY

The present application provides a push type rotary guide drilling system so as to solve at least one of the above technical problems.

A technical solution adopted by the present application is as follows:

a push type rotary guide drilling system includes a drill bit and a rotating shaft for driving the drill bit to rotate, wherein the rotating shaft includes an upper rotating shaft and a lower rotating shaft connected to the drill bit. The push type rotary guide drilling system further includes: a steering portion, sleeving outer sides of the upper rotating shaft and the lower rotating shaft; a push assembly, arranged at one end, proximal to the drill bit, of the steering portion and including a plurality of push pieces spaced along a circumferential direction of the steering portion; a transmission device, including transmission mechanisms which are in one-to-one correspondence to the push pieces for driving the push pieces to move to extend out of the steering portion, wherein each of the transmission mechanisms includes a driving electromagnetic gear arranged on the upper rotating shaft and a driven electromagnetic gear driven by the driving electromagnetic gear to rotate and arranged on the steering portion, the transmission mechanism further includes a motion conversion unit arranged on the steering portion, and the motion conversion unit is suitable for converting rotary motion of the driven electromagnetic gear into linear motion of the push pieces; and a control unit arranged on the upper rotating shaft, wherein the control unit is electrically connected to the driving electromagnetic gear and is configured to modulate a magnetic field to make the driving electromagnetic gear and the driven electromagnetic driven gear realize linkage through magnetic coupling and make the driving electromagnetic gear and the driven electromagnetic driven gear operate in a transmission ratio.

The drilling system further includes a data acquisition unit, wherein the data acquisition unit includes a dynamic posture measuring module and a detection module; the dynamic posture measuring module is arranged on the upper rotating shaft and is configured to acquire underground data and rotating speed data of the upper rotating shaft and transmit the detected data to the control unit; the detection module is configured to measure relative rotating speed information and position information between the upper rotating shaft and the steering portion and transmit the detected information to the control unit; and the control unit modulates the magnetic field according to the underground data and the rotating speed data of the upper rotating shaft and the relative rotating speed information and the position information between the upper rotating shaft and the steering portion.

Further, the detection module includes a contactless position sensor which is arranged on the upper rotating shaft and a cooperating piece which is arranged on the steering portion and can cooperate with the contactless position sensor to realize information detection, wherein the contactless position sensor is electrically connected to the control unit.

Further, the control unit modulates the magnetic field by adjusting excitation, frequency, current and/or voltage supplied to the driving electromagnetic gear, so that the driving electromagnetic gear and the driven electromagnetic gear obtain the transmission ratio.

Further, the motion conversion unit includes a first motion conversion piece, a second motion conversion piece and a connecting piece, wherein the first motion conversion piece is respectively connected to the driven electromagnetic gear and the connecting piece, and the first motion conversion piece is suitable for converting rotary motion of the driven electromagnetic gear into linear motion of the connecting piece; and the second motion conversion piece is respectively connected to the connecting piece and the push piece, and the second motion conversion piece is suitable for converting the linear motion of the connecting piece into movement of the push piece along a radial direction of the steering portion.

Further, a moving direction of the connecting piece is parallel to an axial direction of the steering portion.

Further, in a state where the rotating shaft rotatably drives the drill bit, the steering portion is substantially in a non-rotating state relative to the rotating shaft.

Further, the upper rotating shaft and the steering portion are arranged coaxially, the upper rotating shaft comprises a main body portion and an extending portion fixedly connected to the main body portion, the control unit is arranged on the main body portion, and the driving electromagnetic gear is arranged on the extending portion, and the extending portion at least partially coincides with the steering portion along the axial direction of the steering portion.

The drilling system further includes a first friction pair arranged between the upper rotating shaft and the steering portion, the first friction pair including a first inner bearing and a first outer bearing; and a second friction pair arranged between the lower rotating shaft and the steering portion, the second friction pair including a second inner bearing and a second outer bearing.

Due to the above technical solution, the present application achieves the following beneficial effects:

1. Compared with the technical solution that the extending action of the push piece is driven by the mechanical-electrical-hydraulic integrated system arranged in the steering portion, the present application adopts an electromagnetic gear magnetic transmission mode to realize mechanical contactless power transmission and convert the rotary motion of the rotating shaft into the linear motion of the push piece by the motion conversion unit.

On one hand, it is necessary to set a circuit component, a conductive socket and the like on the steering portion, thereby simplifying the internal structure of the steering portion, effectively shortening the size of the steering portion, benefiting miniaturization of the whole guide drilling system, improving the flexibility of underground feeding motion of the guide drilling system and reducing cost.

On the other hand, since it is unnecessary for the steering portion to be provided with the circuit component, the conductive socket and the like, the reliability of the transmission device is little affected by the underground impurities, and the sealing requirement on the joint gaps between the upper rotating shaft and the steering portion, between the lower rotating shaft and the steering portion and between the push piece and the steering portion is greatly reduced, thereby reducing the sealing cost and improving the reliability and stability of working performance.

Furthermore, since the electromagnetic gear adopts contactless transmission, the transmission process of the driving electromagnetic gear and the driven electromagnetic gear needs no lubrication, avoids friction loss, wear and vibration noise and is stable in transmission; and the electromagnetic gear has low starting moment, has adjustable output force of the system, has an overload protection function, and can adapt to asymmetry and can ensure the output stability of the action force of the push piece even if under the harsh environment conditions of underground vibration and impact, thereby ensuring the smoothness and reliability of posture adjustment.

2. The control unit in the present application can adjust braking, so that the driving electromagnetic gear and the driven magnetic gear can operate in an expected transmission ratio to adjust the output action force of the guide drilling system, thus adjusting the build-up rate. As a preferred implementation manner of the present application, the data acquisition unit transmits the detected information to the control unit, and the control unit may modulate the magnetic field according to the underground environment and the relative posture information of the upper rotating shaft and the steering portion to change the transmission ratio of the driving electromagnetic gear to the driven electromagnetic gear in real time, thereby realizing dynamic real-time adjustment of the drill bit posture. Furthermore, in the present application, the transmission ratio of the driving electromagnetic gear to the driven electromagnetic gear is realized by modulating the magnetic field, and the adjustable range is large, so that a larger optional build-up rate range can be provided to meet the requirements of different strata, thus enlarging the application range of the rotary guide drilling system in the present application.

3. As a preferred implementation manner of the present application, the relative rotating speed and the relative position of the upper rotating shaft and the steering portion are detected through cooperation of the contactless position sensor and the cooperating piece, the cooperating piece may detect and acquire data and information only by cooperating with the contactless position sensor, and the cooperating piece does not need to adopt electronic detection components; therefore, it is unnecessary to set an electric interface on the steering portion, the structure of the steering portion is further simplified, the size of the steering portion is shortened, and the problems in the prior art that the sealing cost is increased and the reliability is reduced because it is necessary to set the electronic component in the steering portion to realize real-time posture detection of the steering portion are solved.

4. As a preferred implementation manner of the present application, the control unit can adjust braking by adjusting excitation, frequency, current and/or voltage of the driving electromagnetic gear, so that the driving electromagnetic gear and the driven magnetic gear can operate in an expected transmission ratio to adjust a moment transmitted to each motion conversion unit in the steering portion according to the underground environment and adjust the action force of the push block, thereby adjusting the build-up rate. In addition, the diversity of the braking adjustment provides multiple choices for control of the transmission ratio, and the transmission ratio may be adjusted and controlled simply by controlling the corresponding circuit, so that the control cost is reduced, the control mode is simple and feasible, and the complex working conditions of the drilling technology are adapted well.

5. As a preferred implementation manner of the present application, in a state where the rotating shaft rotatably drives the drill bit, the steering portion is substantially in a non-rotating state relative to the rotating shaft, and the non-rotating state is not absolutely stationary. In the actual working process, the steering portion rotates at a low speed due to the friction force and the inertia effect, and the non-rotating state of the steering portion relative to the rotating shaft may provide conditions for adjusting the posture of the drill bit, thereby facilitating posture control of the drill bit.

6. As a preferred implementation manner of the present application, a first friction pair is arranged between the upper rotating shaft and the steering portion, and a second friction pair is arranged between the lower rotating shaft and the steering portion. Through the first friction pair and the second friction pair, friction forces between the upper and lower rotating shafts and the contact end faces of the steering portion may be reduced when the upper rotating shaft and the lower rotating shaft rotate relative to the steering portion and the wear resistance of the guide drilling system may be improved; meanwhile, frictions forces between the upper and lower rotating shafts and the contact end faces of the steering portion along the radial directions of the upper rotating shaft and the lower rotating shaft may be reduced, so that the upper rotating shaft and the lower rotating shaft can be centered in the dynamic operation process and the operation reliability and stability of the guide drilling system are ensured.

BRIEF DESCRIPTION OF DRAWINGS

The drawing described herein is used to provide a further understanding of the present application and form a part of the present application. The schematic embodiments and descriptions of the present application are used to explain the present application and do not constitute an undue limitation on the present application.

The drawing described is a structural schematic diagram of a push type rotary guide drilling system in an implementation manner of the present application.

In the drawing:

1 drill bit;

2 upper rotating shaft; 21 main body portion; 22 extending portion;

3 lower rotating shaft; 31 first connecting portion; 32 second connecting portion;

4 steering portion;

5 push piece;

61 transmission mechanism; 611 driving electromagnetic gear; 612 driven electromagnetic gear; 613 first motion conversion piece; 614 connecting piece; 615 second motion conversion piece; 62 control unit;

71 dynamic posture measuring module; 721 contactless position sensor; 722 cooperating piece;

8 first friction pair;

9 second friction pair.

DETAILED DESCRIPTION OF EMBODIMENTS

In order to explain the overall conception of the present application more clearly, a detailed description will be given below by way of examples in combination with the accompanying drawing of the description.

In the following description, many specific details are set forth in order to facilitate full understanding of the present application, but the present application can also be implemented in other ways other than those described herein. Therefore, the protection scope of the present application is not limited by the specific embodiments disclosed below.

In addition, in the description of the present application, it should be understood that an azimuth or position relationship indicated by terms "center", "upper", "lower", "front", "rear", "left", "right", "vertical", "horizontal", "top", "bottom", "inner", "outer", "axial", "radial", "circumferential" and the like is an azimuth or position relationship based on the accompanying draws, which is only for facilitating description of the present application and simplifying description, but not indicates or implies that the referred device or component must have a specific azimuth and perform construction and operation in the specific azimuth; therefore, it cannot be interpreted as a limitation to the present application.

Besides, the terms 'first', 'second' are used only for description and shall not be interpreted as an indication or implication of relative importance or an implicit indication of the number of technical features. Thus, features defined with "first" and "second" may explicitly or implicitly include one or more of the features. In the description of the present application, "a plurality of" means two or more, unless otherwise specifically defined.

In the present application, unless otherwise specified and limited, the terms "mounting", "connected", "connection", "fixation" and the like should be understood in a broad sense, for example, it may be fixed connection, and may also be detachable connection, or integrated; it may be mechanical connection, may be electric connection and may also be communication; and it may be direction connection, may be indirect connection through an intermediate medium, and may be internal communication of two components or interaction relationship between two components. A person of ordinary skill in the art may understand specific meanings of the above-mentioned terms in the present application based on the specific situation.

In the present application, unless otherwise specified and limited, the first feature "on" or "below" the second feature may be direct contact of the first feature and the second feature, or indirect contact of the first feature and the second feature through the intermediate medium. In the description of the specification, the description of the terms "one example", "some examples", "example", "specific example" or "some examples", etc. means that a specific feature, structure, material or characteristic described in combination with the example or example are included in at least one example or example of the present application. In the present specification, the schematic representation of the above terms does not necessarily mean the same example or example. Furthermore, the particular features, structures, materials, or characteristics described may be combined in a suitable manner in any one or more examples or examples.

As shown in the drawing, a push type rotating guide drilling system includes a drill bit 1 and a rotating shaft which is configured to drive the drill bit 1 to rotate and includes an upper rotating shaft 2 and a lower rotating shaft 3 connected to the drill bit 1.

The drilling system further includes: a steering portion 4, sleeving outer sides of the upper rotating shaft 2 and the lower rotating shaft 3.

a push assembly, arranged at one end, proximal to the drill bit 1, of the steering portion 4 and including a plurality of push pieces 5 spaced along a circumferential direction of the steering portion 4; a transmission device, including transmission mechanisms 61 which are in one-to-one correspondence to the push pieces 5 to drive the push pieces 5 to move to extend out of the steering portion 4, wherein each of the transmission mechanisms 61 includes a driving electromagnetic gear 611 which is arranged on the upper rotating shaft 2 and a driven electromagnetic gear 612 which is driven by the driving electromagnetic gear 611 to rotate and arranged on the steering portion 4, the transmission mechanism 61 further includes a motion conversion unit arranged on the steering portion 4, and the motion conversion unit is suitable for converting rotary motion of the driven electromagnetic gear 612 into linear motion of the push pieces 5; and a control unit 62 arranged on the upper rotating shaft 2, wherein the control unit 62 is configured to modulate a magnetic field to make the driving electromagnetic gear 611 and the driven electromagnetic gear 612 realize linkage through magnetic coupling and make the driving electromagnetic gear 611 and the driven electromagnetic gear 612 operate in an adjustable transmission ratio.

It should be noted that the present application does not specifically limit the number of the push pieces. As a preferred embodiment of the present application, three push pieces 5 are spaced in a circumferential direction of the steering portion. Further, the three push pieces 5 are arranged uniformly along the circumferential direction of the steering portion. One push piece 5 is driven by one set of transmission mechanism 61 correspondingly. A transmission ratio of the driving electromagnetic gear 611 to the driven electromagnetic gear 612 in each set of transmission mechanism is controlled by the control unit, the transmission ratio of the driving electromagnetic gear 611 to the driven electromagnetic gear 612 is adjusted by the control unit, the transmission ratio of each set of transmission mechanism may be the same and may also be different, an output force of each push piece 5 is controlled by controlling the transmission ratio, each push piece 5 extends out from the steering portion and is close to a well wall, the steering portion does not rotate along with the upper rotating shaft and the lower rotating shaft under the action of the friction force, the well wall generates a counter-acting force to each push piece, and a resultant force of the counter-acting forces applied to the plurality of push pieces may form a guide force with any size and direction, thereby adjusting the posture of the drill bit, enabling the drill bit to laterally cut the stratum of the well wall and completing guide operation. When guidance is not required, the control unit controls to cut off power supply of the driving electromagnetic gear and the push pieces stop working.

In the present application, the motion that the push piece 5 extends out of the steering portion is driven by the transmission mechanism 61, and the transmission mechanism 61 realizes mechanical contactless power transmission through magnetic coupling of the driving electromagnetic gear 611 arranged on the upper rotating shaft 2 and the driven electromagnetic gear 612 arranged on the steering portion 4. Compared with the previous contact transmission, the power transmission mode of the driving electromagnetic gear and the driven electromagnetic gear in the present application can reduce mechanical wear of the transmission link, and has a simple structure, few parts, low cost and operation reliability and stability. Furthermore, compared with the traditional motor driving rotation mode, the problem of serious heating of the motor may be effectively avoided, the width of the drilling system can be obviously reduced while smooth progress of the drilling work is ensured, the flexibility of the whole machine is improved, and feeding of the whole machine is facilitated. Furthermore, since the electromagnetic gear has low starting moment, has an overload protection function in the transmission mechanism, and can adapt to asymmetry and can ensure the output stability of the action force of the push piece even if under the harsh environment conditions of underground vibration and impact, thereby ensuring the smoothness and reliability of posture adjustment. In addition, the electromagnetic gear is a pollution-free environment-friendly product, which greatly reduce noise pollution and environmental pollution during drilling.

Compared with the technical solution that the extending action of the push piece is driven by the mechanical-electrical-hydraulic integrated system arranged in the steering portion, on one hand, due to the mechanical contactless transmission mode in the present application, it is unnecessary to set a circuit component, a conductive socket and the like in the steering portion 4, thereby simplifying the inner structure of the steering portion 4, reducing the size of the steering portion 4 and reducing the size of the whole guide drilling system, the decrease of the size of the whole machine not only reduces the cost, but also improves the flexibility of underground feeding motion of the guide drilling system; and on the other hand, it is unnecessary to set the circuit component in the steering portion, so that the sealing cost of the steering portion is reduced and the operation reliability and stability of the drilling system are improved.

In the present application, the control unit 62 can adjust braking, so that the transmission ratio of the driving electromagnetic gear 611 and the driven magnetic gear 612 can be adjusted in real time, and the driving electromagnetic gear 611 and the driven magnetic gear 612 can operate in an expected transmission ratio to adjust the output action force of the guide drilling system, thus adjusting the build-up rate.

As shown in the drawing, as a preferred implementation manner of the present application, the drilling system further includes a data acquisition unit, wherein the data acquisition unit comprises a dynamic posture measuring module 71 and a detection module; the dynamic posture measuring module 71 is arranged on the upper rotating shaft and is configured to acquire underground data and rotating speed data of the upper rotating shaft 2 and transmit the detected data to the control unit 62; the detection module is configured to measure relative rotating speed information and position information between the upper rotating shaft 2 and the steering portion 4 and transmit the detected information to the control unit 62; and the control unit 62 modulates the magnetic field according to the data and the information. More specifically, the control unit 62 controls operation of the driving electromagnetic gear 611 and the driven electromagnetic gear 612 according to underground data transmitted by the data acquisition unit and the relative posture information of the upper rotating shaft 2 and the steering portion 4, thus dynamically adjusting the posture of the drill bit 1 in real time.

As a preferred embodiment of the implementation manner, as shown in the FIG. 1, the detection module includes a contactless position sensor 721 which is arranged on the upper rotating shaft 2 and a cooperating piece 722 which is arranged on the steering portion 4 and can cooperate with the contactless position sensor 721 to realize information detection, wherein the contactless position sensor 721 is electrically connected to the control unit 62.

The relative rotating speed and the relative position of the upper rotating shaft 2 and the steering portion 4 are detected through cooperation of the contactless position sensor 721 and the cooperating piece 722, the cooperating piece 722 only needs to cooperate with the contactless position sensor 721, and the cooperating piece 722 does not need to adopt an electronic detection component; therefore, it is unnecessary to set an electric interface on the steering portion 4, the structure of the steering portion 4 is simplified and the size of the steering portion 4 is effectively shortened, thus miniaturizing the guide drilling system, improving the flexibility of the underground feeding motion of the whole guide drilling system and reducing the cost.

As a preferred embodiment of the embodiment, the contactless position sensor 721 is an electromagnetic induction sensor. By adoption of the electromagnetic induction sensor, mechanical displacement loss in measurement is avoided, and high reliability and long service life are achieved.

Of course, the contactless position sensor 721 may also adopt other types of sensors as long as contactless detection of the relative rotating speed and the relative position of the upper rotating shaft 2 and the steering portion 4 can be realized, for example, Hall components, laser sensors, infrared sensors, photoelectric sensors and the like.

Further, the control unit 62 modulates the magnetic field by adjusting excitation, frequency, current and/or voltage supplied to the driving electromagnetic gear 611, so that the driving electromagnetic gear 611 and the driven electromagnetic 612 obtain an adjustable ratio. The so-called adjusting the excitation supplied to the driving electromagnetic gear 611 refers to adjusting and controlling the magnetic field generated by the driving electromagnetic gear by controlling to turn on and off the control circuit for controlling the driving electromagnetic gear.

The transmission ratio of the driving electromagnetic gear 611 to the driven electromagnetic gear 612 changes, the corresponding transmission moment also changes, and finally the action force transmitted to the push piece 5 by the motion conversion unit will also change. In the actual working process, the output action force of the whole guide tool may be adjusted by this rule, thus adjusting the build-up rate of the rotary guide system.

Of course, in the implementation manner, the manner in which the control unit 62 changes the transmission ratio of the driving electromagnetic gear 611 to the driven electromagnetic gear 612 is not specifically limited as long as the transmission ratio of the driving electromagnetic gear 611 to the driven electromagnetic gear 612 is changed by changing the magnetic field between the driving electromagnetic gear 611 and the driven electromagnetic gear 612.

For example, as an embodiment of the implementation manner, the driving electromagnetic gear 611 is made of an aluminum nickel cobalt permanent magnet material and has the characteristics of high residual magnetism and low coercive force. The control unit 62 applies instantaneous magnetizing and demagnetizing current pulse to change the magnetization state of the driving electromagnetic gear, so that the magnetic pole number of the driving electromagnetic gear 611 and the driven electromagnetic gear 612 is changed, and the transmission ratio of the driving electromagnetic gear 611 to the driven electromagnetic gear 612 is changed.

For another example, as another embodiment of the implementation manner, a magnetism adjusting pole piece is added between the driving electromagnetic gear 611 and the driven electromagnetic gear 612, and the magnetic field between the driving electromagnetic gear 611 and the driven electromagnetic gear 612 is modulates by the magnetism adjusting pole piece, so that the harmonic wave of the modulated magnetic field interacts with the driving electromagnetic gear and the driven electromagnetic gear, thus driving the driven electromagnetic gear 612 by the driving electromagnetic 611 to rotate.

For another example, as another embodiment of the implementation manner, the control unit 62 changes the size of the magnetic field between the driving electromagnetic gear 611 and the driven electromagnetic gear 612 by changing the size of the applied current, so that the transmission ratio of the driving electromagnetic gear 611 to the driven electromagnetic gear 612 is changed, and the action moment can be adjusted. In the actual application process, the control unit may adjust and control the magnetic field according to the real-time data and information acquired by the data acquisition unit, so that the transmission mechanism may automatically adjust the transmission moment along with the change of the load, the system is stable in transmission and energy consumption is saved.

It should be noted that the control unit in the present application may adjust the transmission ratio of the driving electromagnetic gear to the driven electromagnetic gear in a step-by-step manner or in a stepless manner, and corresponding adjustment may be realized according to the specific working condition in the actual application process. The stepless adjustment manner of electromagnetic coupling belongs to the prior art; therefore, the action principle is not described here in detail.

In the present application, in the state where the rotating shaft rotatably drives the drill bit 1, the steering portion 4 is substantially in a non-rotating state relative to the rotating shaft. The non-rotating state is relative concept, not absolute. In the actual working environment, the steering portion 4 will rotate at a low speed due to the friction force and the inertia action. The steering portion 4 is in the non-rotating state relative to the rotating shaft, which may provide conditions for adjusting the posture of the drill bit 1, thereby facilitating the posture control of the drill bit 1.

The structure of the present application is described below in detail with reference to the accompanying drawings.

As a preferred implementation manner of the present application, as shown in FIG. 1, the motion conversion unit includes a first motion conversion piece 613, a second motion conversion piece 615 and a connecting piece 614, wherein the first motion conversion piece 613 is respectively connected to the driven electromagnetic gear 612 and the connecting piece 614, and the first motion conversion piece 613 is suitable for converting rotary motion of the driven electromagnetic gear 612 into linear motion of the connecting piece 614; and the second motion conversion piece 615 is respectively connected to the connecting piece 614 and the push piece 5, and the second motion conversion piece 615 is suitable for converting the linear motion of the connecting piece 614 into movement of the push piece 5 along the radial direction of the steering portion 4.

According to the present application, the push piece 5 is driven through the first motion conversion piece 613, the second motion conversion piece 615 and the connecting piece 614, so that the circuit component in the steering portion 4 is avoided, the structure of the steering portion 4 is simplified and the size of the steering portion 4 is greatly shortened, thus shortening the size of the whole rotary guide drilling system, reducing the cost and improving the flexibility of the underground feeding motion of the guide drilling system. In addition, since it is unnecessary to set the circuit component in the steering portion, the steering portion is little affected by the underground impurities, thereby reducing the requirement on sealing and greatly reducing the sealing cost.

As a preferred embodiment of the implementation manner, the movement direction of the connecting piece 614 is parallel to the axial direction of the steering portion 4, so that arrangement of each structural component in the steering portion 4 is facilitated, the radial size of the steering portion 4 is shortened and miniaturization of the drilling system is facilitated.

Of course, the movement direction of the connecting piece 614 may form a certain included angle with the axis of the steering portion 4 according to actual requirements, thereby improving the transmission efficiency.

It should be noted that the implementation manner does not specifically limit the structure of the first motion conversion piece 613 as long as the rotary motion of the driven electromagnetic gear 612 can be converted into the linear motion of the connecting piece 614, which includes, but is not limited to the forms described by the following embodiments:

embodiment 1: the first motion conversion piece 613 is a cam mechanism, the cam mechanism includes a rotating shaft and a cam sleeving the rotating shaft, the rotating shaft is driven by the driven electromagnetic gear 612 to rotate, one end of the connecting piece 614 is in contacted with a cam surface of the cam, and the cam surface pushes the connecting piece 614 to do linear motion along the axial direction of the steering portion 4 in the process that the driven electromagnetic gear 612 drives the cam to rotate. By adoption of the cam mechanism, the connecting piece may obtain any expected motion and travel only by designing a cam surface outline; furthermore, the structure is simple, compact and convenient to design.

Embodiment 2: the first motion conversion piece 613 is a ball screw, the ball screw includes a screw rod and a nut sleeving the screw rod, the screw rod is driven by the driven electromagnetic gear 612 to rotate so as to drive the nut to move, and the connecting piece 614 is connected to the nut. The driven electromagnetic gear 612 rotatably drives the screw rod to rotate, and the screw rod drives the nut to do linear motion so as to drive the connecting piece 614 to do linear motion along the axial direction of the steering portion 4. By adoption of the ball screw, small friction loss and high transmission efficiency are achieved, and high-speed feeding and micro-feeding may be realized.

Meanwhile, the implementation manner does not specifically limit the structure of the second motion conversion piece 615 as long as the linear motion of the connecting piece 614 can be converted into the linear motion of the push piece 5 along the radial direction of the steering portion 4, which includes, but is not limited to the forms described by the following embodiments:

embodiment 1: the second motion conversion piece 615 is a sliding block, and one side, facing towards the push piece 5, of the sliding block is an inclined surface; the connecting piece 614 drives the sliding block to feed along the axial direction of the steering portion 4 when doing linear motion along the axis direction of the steering portion 4; and the push piece 5 moves along the radial direction of the steering portion under the action of the inclined surface of the sliding block. By adoption of the inclined surface structure, the structure is simple and efficiency is high.

Embodiment 2: the second motion conversion piece 615 is a crank-rocker mechanism, and the crank-rocker mechanism includes a crank and a rocker hinged to the crank. As a preferred example of the embodiment, the push piece 5 is connected to the rocker, the connecting piece 614 drives the crank to move, and the crank drives the rocker to move along the radial direction of the steering portion 4 so as to drive the push piece 5 to move along the radial direction of the steering portion 4. According to the embodiment, the push piece 5 is driven by the crank-rocker mechanism and high quick-return characteristic is achieved, so that the extending action of the push piece 5 is more stable; the return action speed of the push piece 5 is increased, so that the working efficiency of the push piece 5 and the timeliness of response are improved; and the crank-rocker mechanism is convenient and simple to make and easy to implement.

The steering portion 4 is provided with a mounting groove for mounting the push piece 5. As a preferred implementation manner of the present application, the push piece 5 is provided with a limiting portion for preventing the pushing piece 5 from being removed from the mounting groove, and an outer diameter of the limiting portion is greater than an inner diameter of the mounting groove. Further, an elastic reset piece which is connected to the push piece 5 to assist the push piece 5 in resetting is arranged in each mounting groove.

In the drilling process, the push piece 5 serves as a part in direct contact with a well wall. To improve the wear resistance and prolong the service life of the push piece, a wear-resistant layer is arranged on one side, in contact with the well wall, of the push piece 5, preferably, the wear-resistant layer is hard alloy.

As shown in FIG. 1, as a preferred implementation manner of the present application, the upper rotating shaft 2 and the steering portion 4 are arranged coaxially, the upper rotating shaft 2 includes a main body portion 21 and an extending portion 22 fixedly connected to the main body portion, the control unit 62 is arranged on the main body portion 21, the driving electromagnetic gear 611 is arranged on the extending portion 22, and the extending portion 22 at least partially coincides with the steering portion 4 along the axial direction of the steering portion 4.

The upper rotating shaft 2 and the steering portion 4 are arranged coaxially, so that posture control of the drill bit 1 is facilitated, the radial size of the drilling system is shortened, and miniaturization of the whole machine is facilitated. The extending portion 22 at least partially coincides with the steering portion 4, which not only creates conditions for magnetic coupling of the driving electromagnetic gear 611 and the driven electromagnetic gear 612, but also facilitates moment transmission from the upper rotating shaft 2 to the lower rotating shaft 3.

Further, the lower rotating shaft 3 and the steering portion 4 are arranged coaxially, the lower rotating shaft 3 is provided with a first connecting portion 31 connected to the upper rotating shaft 2 and a second connecting portion 32 connected to the drill bit 1, and the first connecting portion 31 partially coincides with the steering portion 4 along the axial direction of the steering portion 4.

The lower rotating shaft 3 partially coincides with the steering portion 4, so that the structure of the push type rotary guide drilling system is more stable and the posture is more convenient to adjust.

As a preferred implementation manner of the present application, as shown in FIG. 1, the drilling system further includes a first friction pair 8 arranged between the upper rotating shaft 2 and the steering portion 4, the first friction pair including a first inner bearing and a first outer bearing; and a second friction pair 9 arranged between the lower rotating shaft and the steering portion, the second friction pair including a second inner bearing and a second outer bearing.

As a preferred embodiment of the implementation manner, one of the first inner bearing and the first outer bearing is a radial bearing and the other one is an axial bearing; and one of the second inner bearing and the second outer bearing is a radial bearing and the other one is an axial bearing.

Further, an outer diameter of the main body portion 21 is greater than an outer diameter of the extending portion 22, a first step portion is formed at a joint position of the main body portion 21 and the extending portion 22, and the first friction pair 8 is arranged at the first step portion; and an outer diameter of the first connecting portion 31 is less than an outer diameter of the second connecting portion 32, a second step portion is formed at a joint position of the first connecting portion 31 and the second connecting portion 32, and the second friction pair 9 is arranged at the second step portion. Based on the above size design, outer surfaces of the main body portion 21, the steering portion 4 and the second connecting portion 32 can be located on the same straight line, so that on one hand, step structures are prevented from being formed on a contact end face of the main body portion 21 and the steering portion 4 and a contact end face of the second connecting portion 32 and the steering portion 4, the appearance smoothness of the whole machine is improved and accumulation of external slurry in the outer contour of the whole machine is greatly reduced, and on the other hand, miniaturization of the whole machine is facilitated and the motion flexibility of the whole machine is improved.

Through the first friction pair 8 and the second friction pair 9, the friction force between the contact end faces of the upper rotating shaft 2, the lower rotating shaft 3 and the steering portion 4 may be reduced when the upper rotating shaft 2 and the lower rotating shaft 3 rotate relative to the steering portion 4 and the wear resistance of the guide drilling system is improved; meanwhile, the friction force of the contact end faces of the upper rotating shaft 2, the lower rotating shaft 3 and the steering portion 4 along the radial direction of the upper rotating shaft 2 and the lower rotating shaft 3 may be reduced, the upper rotating shaft 2 and the lower rotating shaft 3 can be centered in the dynamic operation process, and the operation reliability and stability of the guide drilling system are ensured.

The technical content are not mentioned in the present application can be realized by adopting or learning from the prior art.

Each embodiment in the specification is described in a progressive manner. The same and similar parts among the embodiments are referenced to each other. Each embodiment focuses on the differences from other embodiments.

The above is only an embodiment of the present application and is not intended to limit the present application. For those skilled in the art, the application may have various modifications and changes. Any modifications, equivalent substitutions, improvements, etc. made within the spirit and principle of the present application should be included within the scope of the claims of the present application.

What is claimed is:

1. A push type rotary guide drilling system, comprising a drill bit and a rotating shaft which is configured to drive the drill bit to rotate and includes an upper rotating shaft and a lower rotating shaft connected to the drill bit, the system further comprising:

a steering portion, sleeving outer sides of the upper rotating shaft and the lower rotating shaft;

a push assembly, arranged at one end, proximal to the drill bit, of the steering portion and comprising a plurality of push pieces spaced along a circumferential direction of the steering portion;

a transmission device, comprising transmission mechanisms which are in one-to-one correspondence to the push pieces for driving the push pieces to move to extend out of the steering portion, wherein each of the transmission mechanisms comprises a driving electromagnetic gear arranged on the upper rotating shaft and a driven electromagnetic gear driven by the driving electromagnetic gear to rotate and arranged on the steering portion, the transmission mechanism further comprises a motion conversion unit arranged on the steering portion, and the motion conversion unit is suitable for converting rotary motion of the driven electromagnetic gear into linear motion of the push pieces; and a control unit arranged on the upper rotating shaft, wherein the control unit is electrically connected to the driving electromagnetic gear and is configured to modulate a magnetic field to make the driving electromagnetic gear and the driven electromagnetic driven gear realize linkage through magnetic coupling and make the driving electromagnetic gear and the driven electromagnetic driven gear operate in a transmission ratio.

2. The push type rotary guide drilling system according to claim 1, further comprising:

a data acquisition unit, wherein the data acquisition unit comprises a dynamic posture measuring module and a detection module; the dynamic posture measuring module is arranged on the upper rotating shaft and is configured to acquire underground data and rotating speed data of the upper rotating shaft and transmit the detected data to the control unit; the detection module is configured to measure relative rotating speed information and position information between the upper rotating shaft and the steering portion and transmit the detected information to the control unit; and the control unit modulates the magnetic field according to the underground data and the rotating speed data of the upper rotating shaft and the relative rotating speed information and the position information between the upper rotating shaft and the steering portion.

3. The push type rotary guide drilling system according to claim 2, further comprising:

the detection module comprises a contactless position sensor which is arranged on the upper rotating shaft and a cooperating piece which is arranged on the steering portion and can cooperate with the contactless position sensor to realize information detection, the contactless position sensor being electrically connected to the control unit.

4. The push type rotary guide drilling system according to claim 3, wherein in a state where the rotating shaft rotatably drives the drill bit, the steering portion is substantially in a non-rotating state relative to the rotating shaft.

5. The push type rotary guide drilling system according to claim 4, further comprising:

the upper rotating shaft and the steering portion are arranged coaxially, the upper rotating shaft comprises a main body portion and an extending portion fixedly connected to the main body portion, the control unit is arranged on the main body portion, and the driving electromagnetic gear is arranged on the extending portion; and the extending portion at least partially coincides with the steering portion along the axial direction of the steering portion.

6. The push type rotary guide drilling system according to claim 2, further comprising:

the control unit modulates the magnetic field by adjusting excitation, frequency, current and/or voltage supplied to the driving electromagnetic gear, so that the driving electromagnetic gear and the driven electromagnetic gear obtain the transmission ratio.

7. The push type rotary guide drilling system according to claim 6, wherein in a state where the rotating shaft rotatably drives the drill bit, the steering portion is substantially in a non-rotating state relative to the rotating shaft.

8. The push type rotary guide drilling system according to claim 2, wherein in a state where the rotating shaft rotatably drives the drill bit, the steering portion is substantially in a non-rotating state relative to the rotating shaft.

9. The push type rotary guide drilling system according to claim 8, further comprising:

the upper rotating shaft and the steering portion are arranged coaxially, the upper rotating shaft comprises a main body portion and an extending portion fixedly connected to the main body portion, the control unit is arranged on the main body portion, and the driving electromagnetic gear is arranged on the extending portion; and the extending portion at least partially coincides with the steering portion along the axial direction of the steering portion.

10. The push type rotary guide drilling system according to claim 8, further comprising:

a first friction pair arranged between the upper rotating shaft and the steering portion, the first friction pair comprising a first inner bearing and a first outer bearing; and a second friction pair arranged between the lower rotating shaft and the steering portion, the second friction pair comprising a second inner bearing and a second outer bearing.

11. The push type rotary guide drilling system according to claim 1, further comprising:

the motion conversion unit comprises a first motion conversion piece, a second motion conversion piece and a connecting piece;

the first motion conversion piece is respectively connected to the driven electromagnetic gear and the connecting piece, and the first motion conversion piece is suitable for converting rotary motion of the driven electromagnetic gear into linear motion of the connecting piece; and the second motion conversion piece is respectively connected to the connecting piece and the push piece, and the second motion conversion piece is suitable for converting the linear motion of the connecting piece into movement of the push piece along a radial direction of the steering portion.

12. The push type rotary guide drilling system according to claim 11, further comprising:

a moving direction of the connecting piece is parallel to an axial direction of the steering portion.

13. The push type rotary guide drilling system according to claim 12, wherein in a state where the rotating shaft rotatably drives the drill bit, the steering portion is substantially in a non-rotating state relative to the rotating shaft.

14. The push type rotary guide drilling system according to claim 11, wherein in a state where the rotating shaft rotatably drives the drill bit, the steering portion is substantially in a non-rotating state relative to the rotating shaft.

15. The push type rotary guide drilling system according to claim 14, further comprising:

the upper rotating shaft and the steering portion are arranged coaxially, the upper rotating shaft comprises a main body portion and an extending portion fixedly connected to the main body portion, the control unit is arranged on the main body portion, and the driving electromagnetic gear is arranged on the extending portion; and the extending portion at least partially coincides with the steering portion along the axial direction of the steering portion.

16. The push type rotary guide drilling system according to claim 14, further comprising:

a first friction pair arranged between the upper rotating shaft and the steering portion, the first friction pair comprising a first inner bearing and a first outer bearing; and a second friction pair arranged between the lower rotating shaft and the steering portion, the second friction pair comprising a second inner bearing and a second outer bearing.

17. The push type rotary guide drilling system according to claim 1, wherein in a state where the rotating shaft rotatably drives the drill bit, the steering portion is substantially in a non-rotating state relative to the rotating shaft.

18. The push type rotary guide drilling system according to claim 17, further comprising:

the upper rotating shaft and the steering portion are arranged coaxially, the upper rotating shaft comprises a main body portion and an extending portion fixedly connected to the main body portion, the control unit is arranged on the main body portion, and the driving electromagnetic gear is arranged on the extending portion; and the extending portion at least partially coincides with the steering portion along the axial direction of the steering portion.

19. The push type rotary guide drilling system according to claim 18, further comprising:

the lower rotating shaft and the steering portion are arranged coaxially, the lower rotating shaft is provided with a first connecting portion connected to the upper rotating shaft and a second connecting portion connected to the drill bit, and the first connecting portion partially coincides with the steering portion along the axial direction of the steering portion.

20. The push type rotary guide drilling system according to claim 17, further comprising:

a first friction pair arranged between the upper rotating shaft and the steering portion, the first friction pair comprising a first inner bearing and a first outer bearing; and a second friction pair arranged between the lower rotating shaft and the steering portion, the second friction pair comprising a second inner bearing and a second outer bearing.

* * * * *